United States Patent [19]

Szostak et al.

[11] Patent Number: 4,535,710

[45] Date of Patent: Aug. 20, 1985

[54] STABILIZING ARRANGEMENT FOR A SEWING MACHINE CAM POST

[75] Inventors: Jan Szostak, Lincroft; Frank Fennesz, Jr., Manhawkin, both of N.J.

[73] Assignee: The Singer Company, Stamford, Conn.

[21] Appl. No.: 679,341

[22] Filed: Dec. 7, 1984

[51] Int. Cl.[3] ..... D05B 3/00

[52] U.S. Cl. ..... 112/459; 74/569

[58] Field of Search ..... 112/158 A, 158 D; 74/568 R, 569

[56] References Cited

U.S. PATENT DOCUMENTS 2,693,778 11/1954 Harris .
2,924,120 2/1960 Johnson ..... 74/568
3,053,206 9/1962 Grunke .
3,107,548 10/1963 Goetz et al. ..... 74/568
3,792,673 2/1974 Bianchi .
4,313,389 2/1982 Hanyu et al. ..... 112/158 A
4,441,440 4/1984 Weisz .

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

An angularly configured bracket is mounted at one end portion for pivotal adjustment in a sewing machine into a position of engagement at another end portion with fixed machine structure. A fastener extending through a slot in the bracket while the bracket is so adjusted secures the bracket to the upper end of a fixed post having a rotatable work feed controlling cam thereon, and so stabilizes the post against distortion by a spring biased cam engaging follower.

8 Claims, 3 Drawing Figures

STABILIZING ARRANGEMENT FOR A SEWING MACHINE CAM POST

BACKGROUND OF THE INVENTION

1. Field of the Invention

The invention relates to camming for controlling sewing operations on a sewing machine, and more particularly, to arrangements for supporting such camming in a sewing machine.

2. Description of the Prior Art

Sewing machines commonly include rotatable cams on a vertical axis post for use in controlling the movement of sewing machine instrumentalities. Such cams are normally engaged by spring biased cam followers which subject the cam supporting post to a bending moment that deflects the post, and so prevents the proper performance of cam controlled functions on the machine.

It is a prime object of the present invention to provide an improved arrangement for preventing the deflection of a cam supporting post in a sewing machine, and to thereby assure the proper performance of cam controlled functions on the machine.

It is another object of the invention to prevent the deflection of a cam supporting post in a sewing machine with an adjustable bracket which is movable into a supported position against fixed structure in the machine.

Other objects and advantages of the invention will become apparent during a reading of the specification taken in connection with the accompanying drawings.

SUMMARY OF THE INVENTION

A sewing machine with a vertical post which is affixed at one end in the machine, and has a rotatable cam supported on the post for engagement with a spring biased cam follower, is provided with an adjustable post supporting bracket. The bracket is angularly configured and pivotally mounted at one end portion to permit adjustment of the bracket into a position wherein another end portion is supported against fixed machine structure. The bracket includes an elongated slot for a fastner which extends therethrough into the upper end of the post and is used to affix the bracket to the post while said another end portion is against the fixed machine structure.

DESCRIPTION OF THE PREFERRED EMBODIMENT

Figure 1:
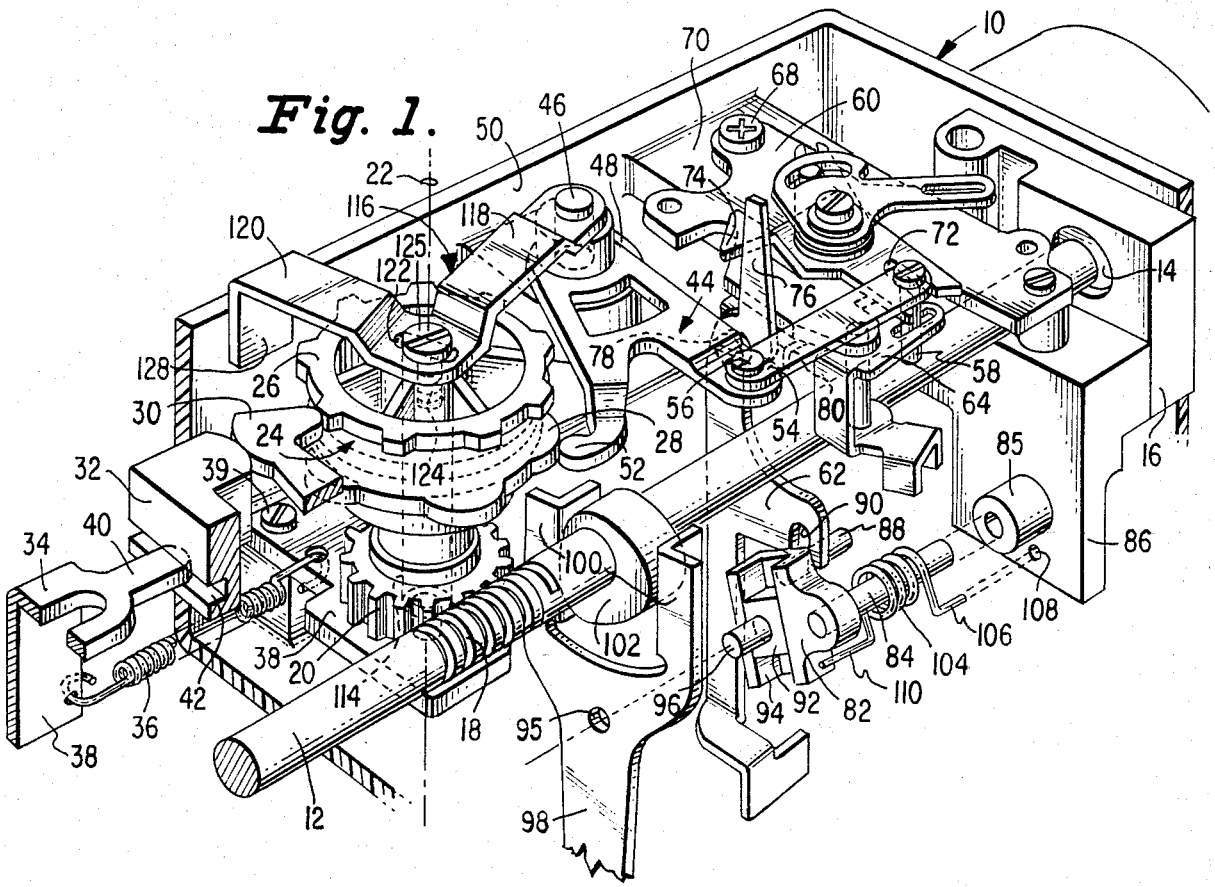
FIG. 1 is a perspective view of a portion of a sewing machine which is constructed according to the invention.
Figure 2:
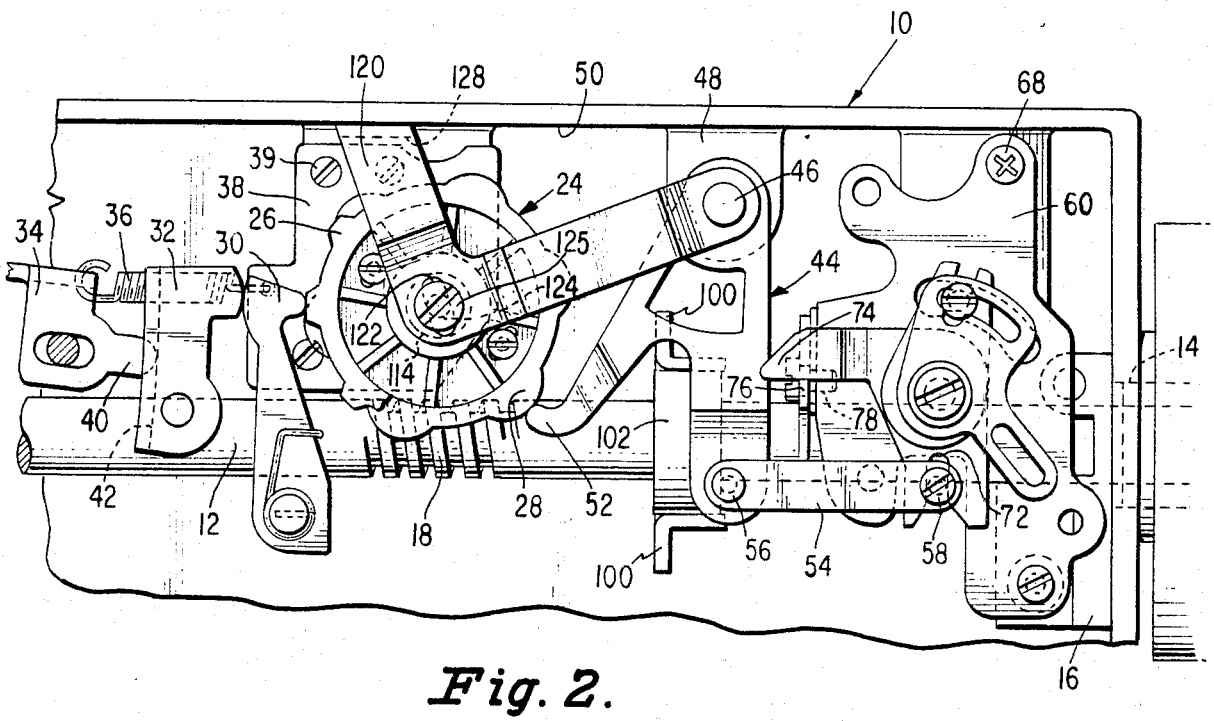
FIG. 2 is a fragmentary top plan view showing the cam post stabilizing arrangement of the invention; and, FIG. 3 is an exploded perspective view showing the construction of the invention.
Figure 3:
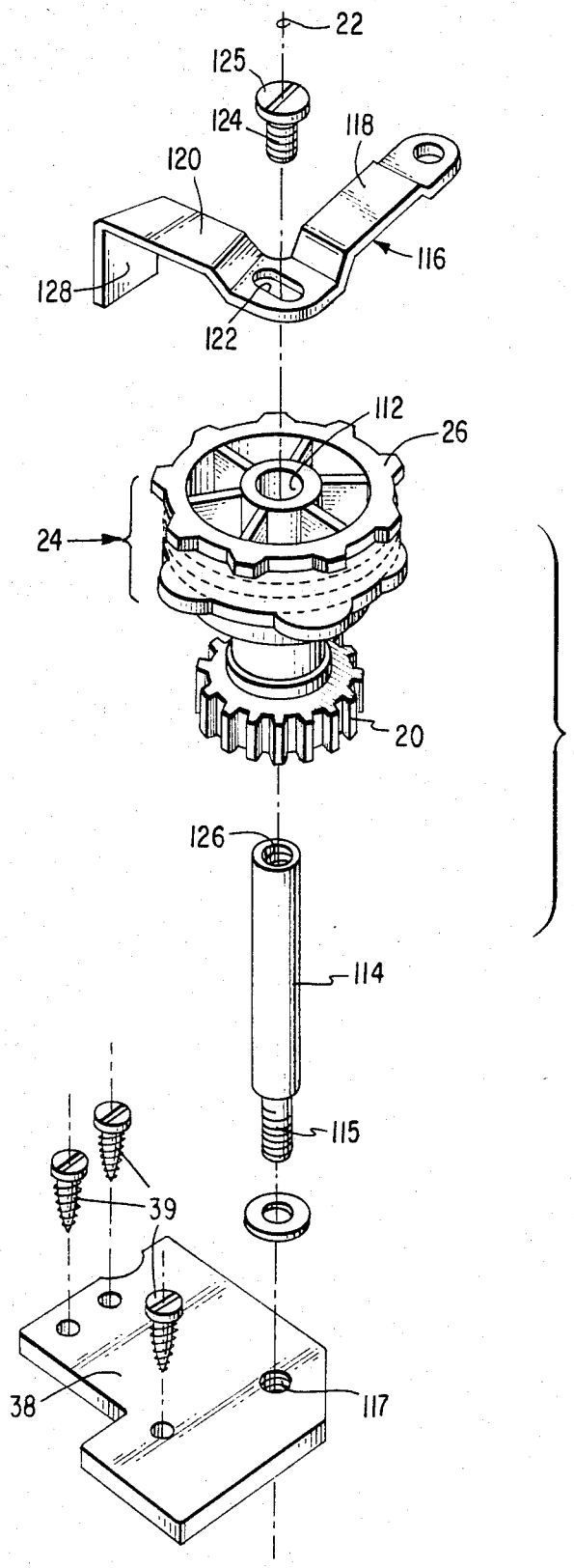

Referring to the drawings, reference character 10 designates a sewing machine housing wherein an arm shaft 12 is rotatably supported on bearings one of which may be seen at 14 in a fixed block 16. A worm 18 on shaft 12 meshes with a gear 20, and imparts rotation about a vertical axis 22 to the gear and thereby to a cam stack 24 during operation of the machine. The cam stack includes a cam 26 for controlling needle bight and a cam 28 for controlling the feeding of work on the machine.

A pivotally movable cam follower 30 is provided for actuation by cam 26. Movement of the cam follower 30 by cam 26 is transmitted through a pivoted lever 32 to a link 34 for use in imparting jogging motion according to the contour of cam 26 to a needle bar gate as commonly provided in zig zag sewing machines. The arrangement and manner of mounting cam follower 30, lever 32 and link 34 in the machine is as exemplified for corresponding components in U.S. Pat. No. 3,753,411 for "Regulator for Cam Controlled Feed in a Sewing Machine", issued Aug. 21, 1973. A spring 36, attached at one end to a plate 38 affixed in the housing 10 with screws 39, and attached at the opposite end to link 34, serves to bias a finger portion 40 of the link against a track 42 in lever 32, and thereby the cam follower 30 against cam 26.

A cam follower 44 is provided for actuation by cam 28. The cam follower is pivotally mounted on a pin 46 affixed in a shelf 48 extending from the rear wall 50 of the machine housing, and is formed with a finger 52 for engagement with cam 28. A link 54 pivoted at 56 on cam follower 44 carries a depending pin 58 which is operably connected by way of a bell crank 60 with a work feed controlling lever 62, and by way of a bell crank 64 with manual control means, all as in a manner shown for like mechanism in U.S. Pat. No. 4,448,141 for "Sewing Machine Cam Controlled Feed Engaging and Disengaging Mechanism", issued May 15, 1984. Bell crank 60 is pivotally mounted with a shouldered screw 68 on a fixed plate 70, and is formed with a radial slot 72 wherein pin 58 is received. Bell crank 60 is also formed with a finger 74 with which to engage the upper end portion 76 of lever 62.

Lever 62 is pivotally mounted with a shoulder screw 78 on a flange 80 depending from plate 70, and is associated with a feed regulating block 82 as in the manner shown in the aforementioned U.S. Pat. No. 4,448,141. Block 82 is pivotally supported on a pin 84 which is affixed in a boss 85 on stationary structure 86, and has a pin 88 extending therefrom into a slot 90 formed in lever 62. A slide block 92 is constrained in a guide slot 94 on feed regulating block 82 and is pivotally mounted at 95 by way of a pin 96 in a pitman 98 having a bifurcated head 100 which embraces a constant breadth cam 102 that is fast on arm shaft 12. A spring 104 having one end 106 extending into a hole 108 in stationary structure 86, and the opposite end 110 bearing against feed regulating block 82 biases the upper end portion 76 of pivoted lever 62 against finger 74 on bell crank 60. Such spring bias acting on bell crank 60 and thereby through link 54, while pin 58 is in slot 72, urges cam follower 44 at finger 52 against cam 28. During cam controlled work feeding operations cam follower 44 is actuated by cam 28, and its motion is transmitted through link 54 and bell crank 60 to lever 62. The angular position of feed regulating block 82 is varied by the motion of lever 62, to control the motion of pitman 98, and thereby the direction and the magnitude of incremental movements of work by conventional work feeding mechanism (such as conventionally used four-motion drop feed mechanism) operably connected to the pitman 98.

The cam stack 24 and gear 20 are a composite assembly which is rotatably supported in a central bore 112 on a vertical post 114 defining axis 22. The post is affixed at a threaded end 115 which is screwed into a threaded hole 117 in plate 38, and is prevented from deflecting about the affixed end with an adjustable bracket 116. As shown, bracket 116 is formed with angularly spaced arms 118 and 120, and with an elongate hole 122 therebetween for a screw 124 to extend therethrough into a threaded hole 126 in the upper end portion of post 114. The bracket is pivotally mounted at the end of arm 118 on pin 46, and hole 122 is formed to enable the bracket, during the assembly of the machine and while screw 124 is loosely threaded in hole 126, to be moved about pin 46 into a position wherein a depending portion 128 of arm 120 is caused to engage the rear wall 50 of the machine. While the bracket is in its adjusted position against the rear wall of the machine, screw 124 is tightened to secure the bracket under the head 125 of the screw to the upper end portion of post 114. Deflection of the post 114 by the spring biased cam follower 44 is then resisted with the support lended to bracket arm 120 by wall 50, while deflection of post 114 by the other spring biased cam follower 30 is resisted by the support lended to bracket arm 118 by pin 46. With the position of post 114 so stabilized, undesirable variations in cam controlled functions is prevented and proper operation is assured.

It is to be understood that the present invention relates to a preferred embodiment of the invention which is for purposes of illustration only, and is not to be construed as a limitation of the invention. Numerous alterations and modifications will suggest themselves to those skilled in the art, and all such modifications which do not depart from the spirit and scope of the invention are intended to be included within the scope of the appended claims.

We claim:

1. In a sewing machine, a vertical post which is affixed at one end in the machine; a rotatable cam for controlling a sewing function, the cam being supported on the post; a cam follower which is spring biased for enforced engagement with the cam, and which while so biased against the cam, subjects the post to a bending moment; a bracket for resisting distortion of the post, the bracket being angularly configured and being pivotally mounted at one end portion in the machine to permit adjustment of the bracket into a position wherein another end portion is supported against fixed machine structure, said bracket including an elongate slot; and a fastener extending through the slot into the upper end of the post for affixing the bracket to the post while said another end portion is against the fixed machine structure.

2. The combination of claim 1 wherein the basket includes a pair of spaced apart arms one of which includes the said one end portion and the other of which includes said another end portion.

3. The combination of claim 1 wherein the cam is a work feed controlling cam.

4. The combination of claim 3, which includes a needle bight controlling cam on the post, and another cam follower which is spring biased for enforced engagement with such needle bight controlling cam.

5. The combination of claim 1 wherein the cam follower is pivotally mounted at the end opposite from the cam engaging end on a fixed pin, and said pin provides the mount for pivotal adjustment of the bracket.

6. The combination of claim 1 wherein the fastener is a screw which extends through said slot into a threaded upper end of the post for affixing the bracket to the post.

7. The combination of claim 1 wherein said fixed structure is the housing of the machine.

8. The combination of claim 1 wherein said fixed structure is the rear wall of the housing of the machine.

* * * * *